US008146364B2

(12) United States Patent
Johnson et al.

(10) Patent No.: US 8,146,364 B2
(45) Date of Patent: Apr. 3, 2012

(54) NON-RECTANGULAR RESONATOR DEVICES PROVIDING ENHANCED LINER COOLING FOR COMBUSTION CHAMBER

(75) Inventors: Clifford E. Johnson, Orlando, FL (US); Robert J. Bland, Oviedo, FL (US); Domenico Gambacorta, Oviedo, FL (US); Samer P. Wasif, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 652 days.

(21) Appl. No.: 11/855,747

(22) Filed: Sep. 14, 2007

(65) Prior Publication Data

US 2009/0094985 A1 Apr. 16, 2009

(51) Int. Cl.
*F02C 7/24* (2006.01)

(52) U.S. Cl. ..... 60/725; 431/114

(58) Field of Classification Search ..... 60/725, 60/752, 754; 431/114
See application file for complete search history.

(56) References Cited

U.S. PATENT DOCUMENTS

| | | | | |
|---|---|---|---|---|
| 5,590,849 | A | 1/1997 | Pla | |
| 5,685,157 | A | 11/1997 | Pandalai et al. | |
| 6,018,950 | A | 2/2000 | Moeller | |
| 6,530,221 | B1 | 3/2003 | Sattinger et al. | |
| 6,550,574 | B2 | 4/2003 | Liu | |
| 6,655,149 | B2 * | 12/2003 | Farmer et al. | 60/754 |
| 6,837,051 | B2 | 1/2005 | Mandai et al. | |
| 7,080,514 | B2 | 7/2006 | Bland et al. | |
| 7,086,232 | B2 * | 8/2006 | Moertle et al. | 60/752 |
| 7,089,741 | B2 | 8/2006 | Ikeda et al. | |
| 7,413,053 | B2 | 8/2008 | Wasif et al. | |
| 2003/0232139 | A1 * | 12/2003 | DeTura | 427/282 |
| 2004/0060295 | A1 | 4/2004 | Mandai et al. | |
| 2005/0034918 | A1 | 2/2005 | Bland et al. | |
| 2006/0053798 | A1 | 3/2006 | Hadder | |
| 2007/0125089 | A1 | 6/2007 | Sattinger | |
| 2007/0169992 | A1 | 7/2007 | Wasif et al. | |

FOREIGN PATENT DOCUMENTS

| | | | |
|---|---|---|---|
| EP | 1510757 | A2 | 3/2005 |
| WO | 0225174 | A1 | 3/2002 |

* cited by examiner

*Primary Examiner* — William Rodriguez
*Assistant Examiner* — Andrew Nguyen

(57) ABSTRACT

Embodiments of the present invention provide resonators (260, 460) that have lateral walls (268, 270) disposed at non-square angles relative to the liner's longitudinal (and flow-based) axis (219) such that a film cooling of substantial portions of an intervening strip (244, 444) is provided from apertures (226A, 226B, 426) in a resonator box (262, 462) adjacent and upstream from the intervening strip (244, 444). This film cooling also cools weld seams (280) along the lateral walls (268, 270) of the resonator boxes (262, 462). In various embodiments the lateral wall angles are such that film cooling may be provided to include the most of the downstream portions of the intervening strips (244, 444). These downstream portions are closer to the combustion heat source and therefore expected to be in greater need of cooling.

20 Claims, 5 Drawing Sheets

NON-RECTANGULAR RESONATOR DEVICES PROVIDING ENHANCED LINER COOLING FOR COMBUSTION CHAMBER

FIELD OF INVENTION

The invention generally relates to a gas turbine engine, and more particularly to a non-rectangular resonator positioned on a combustor of a gas turbine engine.

BACKGROUND OF THE INVENTION

Combustion engines such as gas turbine engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design includes a centralized pilot burner (hereinafter referred to as a pilot burner or simply pilot) and several main fuel/air mixing apparatuses, generally referred to in the art as injector nozzles, arranged circumferentially around the pilot burner. With this design, a central pilot flame zone and a mixing region are formed. During operation, the pilot burner selectively produces a stable flame that is anchored in the pilot flame zone, while the fuel/air mixing apparatuses produce a mixed stream of fuel and air in the above-referenced mixing region. The stream of mixed fuel and air flows out of the mixing region, past the pilot flame zone, and into a main combustion zone of a combustion chamber, where additional combustion occurs. Energy released during combustion is captured by the downstream components to produce electricity or otherwise do work.

It is known that high frequency pressure oscillations may be generated from the coupling between heat release from the combustion process and the acoustics of the combustion chamber. If these pressure oscillations, which are sometimes referred to as combustion dynamics, or as high frequency dynamics, reach a certain amplitude they may cause nearby structures to vibrate and ultimately break. A particularly undesired situation is when a combustion-generated acoustic wave has a frequency at or near the natural frequency of a component of the gas turbine engine. Such adverse synchronicity may result in sympathetic vibration and ultimate breakage or other failure of such component.

Various resonator boxes for the combustion section of a gas turbine engine have been developed to damp such undesired acoustics and reduce the risk of the above-noted problems. For example, U.S. Pat. No. 6,837,051, issued Jan. 4, 2005 to Mandai et al., teaches a side wall defining a combustion volume, the side wall including a plurality of oscillation damping orifices downstream of the main nozzles and extending radially through the side wall, wherein acoustic liners of various configurations are attached to the side wall's outer surface over the location of the orifices, forming acoustic buffer chambers. Also, an arrangement of a more upstream disposed inner tube and a more downstream disposed combustor tail tube provides a film of air that is stated to reduce the fuel-air ratio adjacent the inner surface of the combustor tail tube and restrain combustion-driven oscillation.

U.S. Pat. No. 7,080,514, issued Jul. 25, 2006 to Robert Bland and William Ryan, teaches resonators for a gas turbine engine combustor that each comprise a scoop disposed above a respective resonator. The scoop is stated to capture passing fluid to substantially equalize pressure impinging a resonator plate of the resonator. This is stated to allow more design freedom by allowing for a greater pressure drop across the resonator.

U.S. Pat. No. 7,089,741, issued Aug. 15, 2006 to Ikeda et al., teaches forming a resonance space about a wall of a combustion liner that defines a combustion region. The resonance space connects to the combustion region by a plurality of through-holes. Additionally, cooling holes are provided along the sides of housings that help define the resonance space, stated as desirable along an upstream side and also shown along a downstream side. Purge holes also are provided along a more radially outwardly disposed surface.

While the above approaches may provide one or more favorable features, to address undesired combustion-generated acoustic waves there still remains in the art a need for a more effective and efficient resonator, and for a gas turbine engine comprising such resonator.

BRIEF DESCRIPTION OF THE DRAWINGS

The invention is explained in following description in view of the drawings that show.

DETAILED DESCRIPTION OF EMBODIMENTS OF THE INVENTION

Combustor liner resonators are normally rectangular in overall shape of their respective footprint on the combustor liner, having upstream and downstream walls and lateral (i.e., side) walls set at right angles to the upstream and downstream walls. Some of these resonators may have their footprint with right angles (i.e., welds are at right angles), but the walls angle inward with increasing distance from the combustor liner so as to form a truncated pyramid shape. Combustor liner resonators also are commonly positioned relatively close to the combustion zone, and are therefore exposed to relatively elevated temperatures that may expose their components and weld seams to thermal stress and degradation. Between such adjacent resonators are intervening strips of the liner that are oriented parallel to the flow-based (or longitudinal) axis of the liner. In prior art resonator arrangements these intervening strips, and the weld seams along them, are not provided with a means of cooling as are adjacent liner portions that are part of the adjacent resonators. For example, the liner inside surfaces beneath the resonators receive a cooling fluid flow from apertures in the resonators, and this may provide a film cooling effect. The intervening strips, however, do not receive significant benefit of such film cooling. In certain instances this may lead to uneven cooling and/or greater energy expended to provide cooling sufficient for such intervening strips.

Embodiments of the present invention provide resonators that have lateral walls disposed at non-square angles relative to the liner's longitudinal (and flow-based) axis such that a film cooling of substantial portions of an intervening strip is provided from apertures in a resonator box adjacent and upstream from the intervening strip. This film cooling also cools weld seams along the lateral walls of the resonator boxes. In various embodiments the lateral wall angles are such that film cooling may be provided to include the most of the downstream portions of the intervening strips. These downstream portions are closer to the combustion heat source and therefore expected to be in greater need of cooling.

Additionally, other features, as are described below in discussions of the figures, may be combined with the non-rectangular resonators to achieve even better performance in various embodiments.

Thus, exemplary embodiments of the invention, which are not meant to be limiting as to the scope of the invention as claimed herein, are provided to appreciate various aspects and combinations of embodiments of the invention. First, however, a discussion is provided of a common arrangement of elements of a prior art gas turbine engine into which may be provided embodiments of the present invention.

Figure 1A:
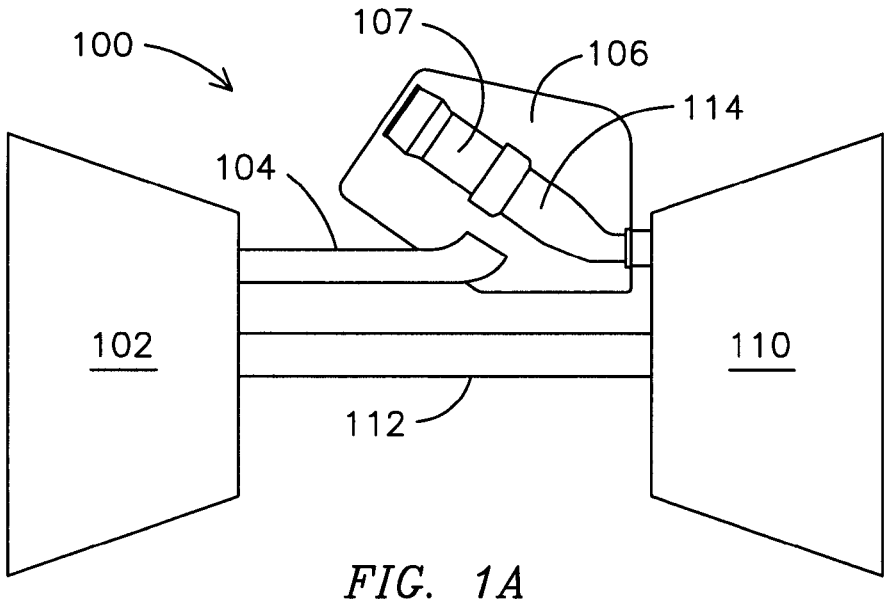
FIG. 1A (PRIOR ART)
FIG. 1A provides a schematic cross-sectional depiction of a prior art gas turbine engine.

FIG. 1A provides a schematic cross-sectional depiction of a prior art gas turbine engine 100 such as may comprise various embodiments of the present invention. The gas turbine engine 100 comprises a compressor 102, a combustor 107, and a turbine 110. During operation, in axial flow series, compressor 102 takes in air and provides compressed air to a diffuser 104, which passes the compressed air to a plenum 106 through which the compressed air passes to the combustor 107, which mixes the compressed air with fuel in a pilot burner and surrounding main swirler assemblies (not shown), after which combustion occurs in a more downstream combustion chamber of the combustor 107, the chamber defined by a liner (see FIG. 1B). Further downstream combusted gases are passed via a transition 114 to the turbine 110, which may be coupled to a generator to generate electricity. A shaft 112 is shown connecting the turbine to drive the compressor 102.

Figure 1C:
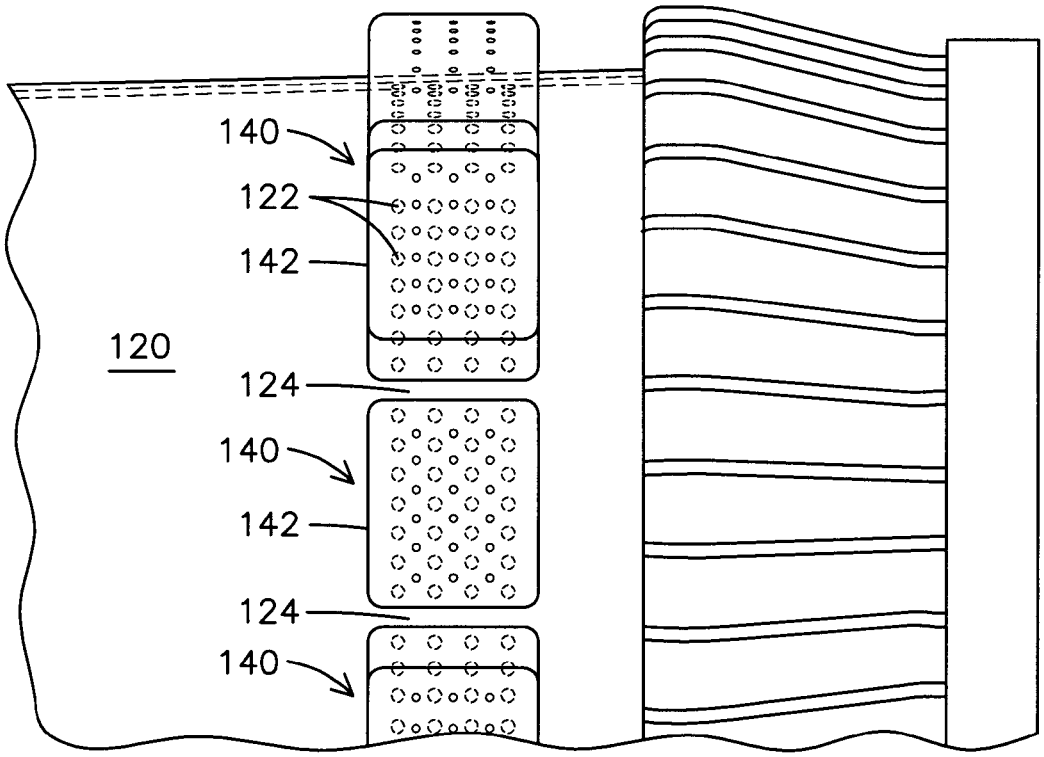
FIG. 1C (PRIOR ART)
FIG. 1C provides an enlarged view of a portion of the combustor in FIG. 1B showing two adjacent resonators with an intervening strip of the combustor liner.
Figure 1B:
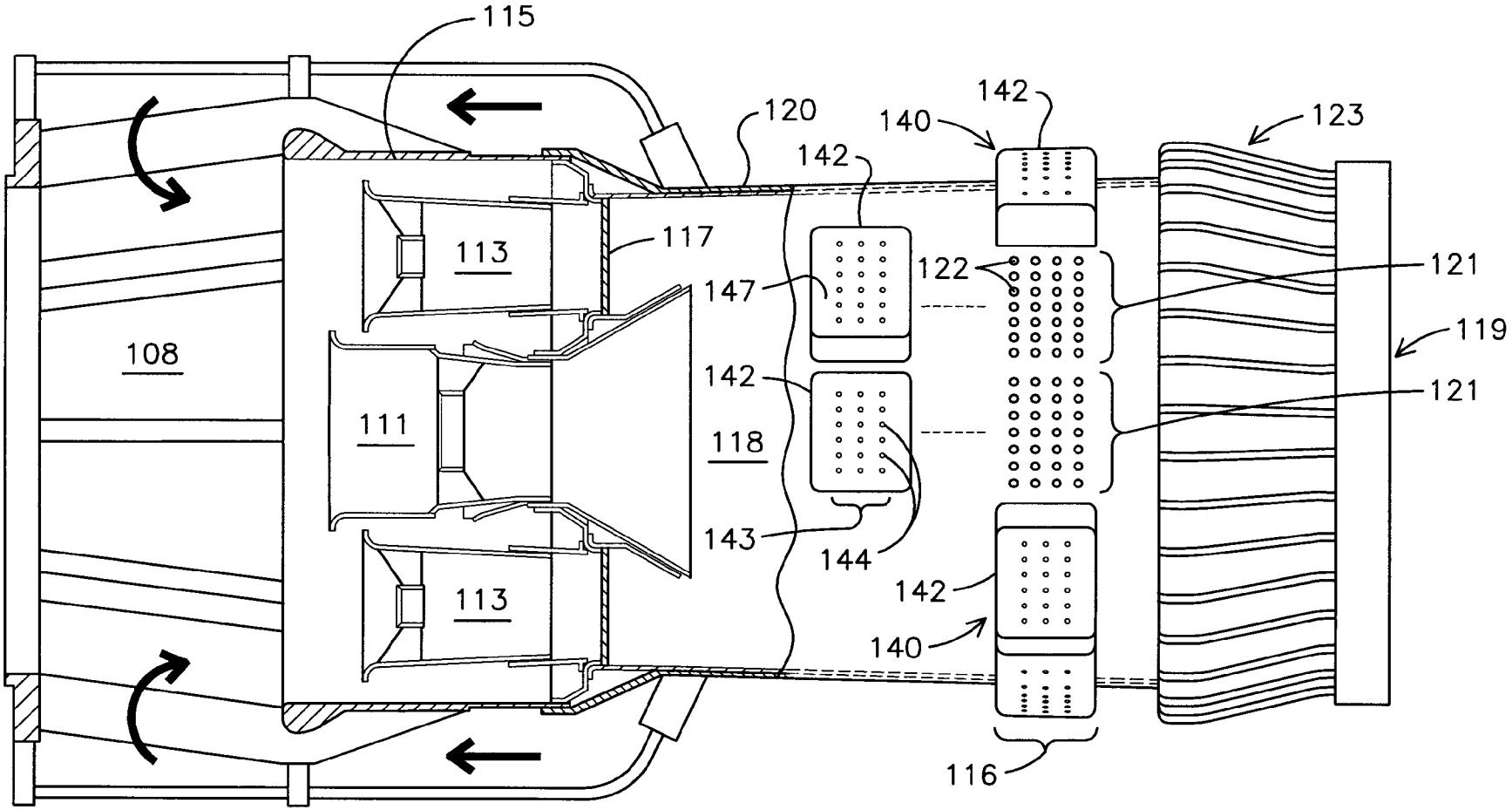
FIG. 1B (PRIOR ART)
FIG. 1B provides a partial cut-away side view a prior art combustor such as used in FIG. 1A, providing a view of an array of resonators, two resonator boxes of which are removed to show apertures in the liner.

FIG. 1B provides a side view of a prior art combustor 107. While not meant to be limiting, the combustor 107 is comprised of a pilot swirler assembly 111 (or more generally, a pilot burner), and disposed circumferentially about the pilot swirler assembly 111 are a plurality of main swirler assemblies 113. These are contained in a combustor housing 115. Fuel is supplied to the pilot swirler assembly 111 and separately to the plurality of main swirler assemblies 113 by fuel supply rods (not shown). A transversely disposed base plate 117 of the combustor 107 receives downstream ends of the main swirler assemblies 113.

During operation, a predominant air flow (shown by thick arrows) from a compressor (not shown, see FIG. 1A) passes along the outside of combustor housing 115 and into an intake 108 of the combustor 107. The pilot swirler assembly 111 operates with a relative richer fuel/air ratio to maintain a stable inner flame source, and combustion takes place downstream, particularly in a combustion zone 118 largely defined upstream by the base plate 117 and laterally by a combustor liner 120. An outlet 119 at the downstream end of combustor 107 passes combusting and combusted gases to a transition (not shown, see FIG. 1), which is joined by means of a combustor-transition interface seal, part of which comprises a spring clip assembly 123.

Further as to aspects of the prior art resonators, along a cylindrical region 116 of the combustor liner 120 are respective arrays 121 of apertures 122 of adjacent resonators. Two resonators 140 are shown complete with resonator boxes 142 in place, and two arrays 121 of apertures 122 are shown with the resonator boxes 142 removed. This provides a view of two arrays 121 of apertures 122 that reveal a squared pattern of apertures arranged in even rows and columns for each of the resonators 140.

FIG. 1C provides an enlarged view of the circled area of FIG. 1B, showing adjacent resonators 140 each with a respective intervening strip 124 between the resonator boxes 142 of the adjacent resonators 140. In that the resonator boxes 142 are depicted in transparent manner, apertures in the cylindrically shaped combustor liner 120 (dashed circles) and in the resonator boxes 142 are shown in this figure. It is noted that, under normal operation, airflow through the apertures 122 in liner 120 of these resonators 140 would not provide a cooling effect to the intervening strip 124, nor to weld joints (not shown) adjacent the intervening strip 124.

Figure 1D:
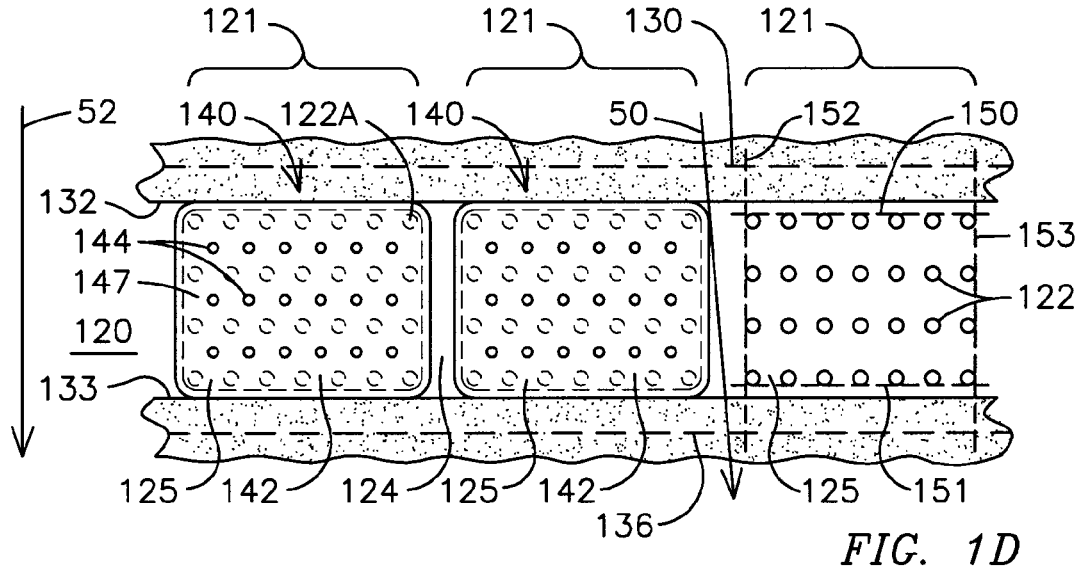
FIG. 1D PRIOR ART
FIG. 1D provides an enlarged view of a portion of the combustor of FIG. 1B depicting three adjacent arrays of apertures with a resonator box covering each of two such arrays, projected onto a planar surface.

FIG. 1D depicts a portion of the liner 120 having three adjacent arrays 121 of apertures 122, with a resonator box 142 covering each of two such arrays 121. The three adjacent arrays 121, which are disposed through the cylindrically shaped liner 120 of FIG. 1B, are projected onto a plane represented by the drawing sheet for purposes of illustration and comparison to similarly projected figures depicting embodiments of the present invention (i.e., providing a vertical orthographic plan view projection of the liner 120 and the resonator boxes 142). As shown for the exposed array 121, each array may be defined geometrically by an upstream edge 150, a downstream edge 151, and two lateral edges 152 and 153. This prior art arrangement shows that the lateral edges 152 and 153 meet both the upstream edge 150 and the downstream edge 151 at right angles.

As may be appreciated from FIGS. 1C and 1D, prior art resonators 140, comprise resonator boxes 142 and arrays 121 of apertures 122 (shown as dashed lines when covered by a resonator box 142) with intervening spaces 124 there between. Each resonator box 142 comprises an array 143 of relatively smaller impingement holes 144 on a top plate 147. Each resonator box 142 is welded onto the liner 120 around a respective array 121 of the relatively larger apertures 122. Also depicted is a vector line 50 that depicts a typical direction of combusting gases that flow through the interior of the liner. It is noted that this vector line 50 is skewed several degrees from a longitudinal axis 52. This is a result of the rotational swirling effect from the main swirlers of the combustor (not shown). As will be appreciated, even in view of the slight skewing of flow direction, any flow out of, for instance upstream and adjacent aperture 122A, would have no to negligible film cooling effect on adjacent intervening strip 124. That is, most of intervening strip 124 would not receive any cooling effect from any of the apertures 122 that are within either adjacent resonator 140.

Also depicted in FIG. 1D are an upstream thermal barrier coating (TBC) edge 132 and a downstream thermal barrier coating (TBC) edge 133. There are thermal barrier coatings on the interior (exposed to combustion gases) surface of liner 120 respectively upstream and downstream of the cylindrical region 116 of the liner 120 which comprises the resonators 140, but not throughout the cylindrical region 116, which remains uncoated to provide better acoustic performance of the resonators, especially at high frequencies. The uncoated region is predominantly cooled by a combination of cooling from the impingement air holes 144 and film cooling from air flow exiting through the apertures 122. The edges 132 and 133 depicted in FIG. 1D are approximate in terms of location to the boxes 142, and may actually largely fall within the region defined by the depicted edges 132 and 133 and the respective adjacent dashed lines 130 and 136 parallel to the depicted edges 132 and 133.

Thus it is appreciated that typical prior art HFD (High Frequency Dynamics) resonator designs are rectangular in shape, as shown in the above figures. The liner, such as liner 120 is perforated with apertures 122 in a specified pattern, typically a rectangular pattern, and the resonators 140, arranged circumferentially about the liner 120 comprise the respective arrays 121 of apertures 122 and resonator boxes, such as boxes 142, that are welded above the respective arrays 121 of apertures 122. Each resonator box 142 also has an array 143 of apertures 144, which provides flowthrough to prevent hot gas ingestion. Overall, the air entering the resonator 140 from the apertures 144 in the resonator box 142 provides impingement cooling (and convective cooling to an extent) to the outside surface of the liner 120. When this air flows through the liner apertures 122, there is also a film cooling effect on the interior hot surface of the liner. However, as noted above, between adjacent resonators there is a portion of the liner, identified herein as an intervening strip, which does not benefit from either the impingement cooling or from subsequent film cooling.

Embodiments of the present invention improve upon such rectangular resonator boxes on a combustor liner. One embodiment of the present invention is exemplified in FIG. 2A. FIG. 2A provides a perspective view of a combustor liner 220 of a combustor for a gas turbine engine such as that depicted in FIG. 1A, which may have components such as those described for FIG. 1B. The combustor liner 220 comprises an upstream end 220U and a downstream end 220D and defines in part an interior combustion chamber 221 having a flow-based longitudinal axis, indicated by arrow 219. The combustor liner 220 comprises a cylindrical region 216 comprising a plurality of circumferentially arranged arrays 225 of apertures 226 through the liner 220, each of which is a component of a resonator 260 of the present invention. Some of these apertures 226 are viewed along the interior surface 222 of the liner 220 (large portions of which may be covered in various embodiments with a thermal barrier coating (TBC), not depicted in FIG. 2A, see FIG. 2B). Each said array 225 may be defined geometrically by a non-rectangular four-sided shape having an upstream edge 227, a downstream edge 228 which in the embodiment of FIG. 2A is substantially parallel with the upstream edge 227 (but wherein this is not meant to be limiting), and two lateral edges 229 and 330. It is appreciated that the array 225 is on a portion of the cylindrically curved liner 220, and it is further provided that each lateral edge 229 and 330, when the array 225 is projected array onto a plane, intersects with the upstream edge 227 and with the downstream edge 228 at an angle other than a right angle. The advantageous consequences of this design are discussed below.

Also as depicted in FIG. 2A, a plurality of resonator boxes 262 are affixed to the liner, each said resonator box 262 covering a respective array and having lateral walls (see FIG. 2B) disposed to conform with the respective angles of lateral edges 229 and 330. Two resonator boxes 262 are shown not affixed so as to provide a view of the respective arrays 225 discussed above.

Figure 2B:
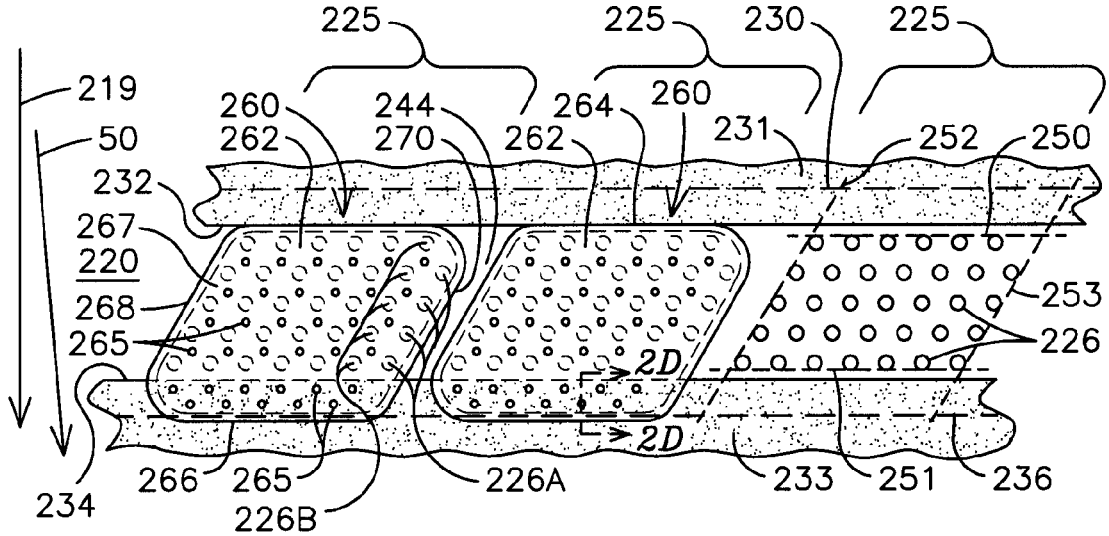
FIG. 2B provides an enlarged view of a portion of the combustor liner of FIG. 2A, depicting three adjacent arrays of apertures with a resonator box covering each of two such arrays, projected onto a planar surface.
Figure 2A:
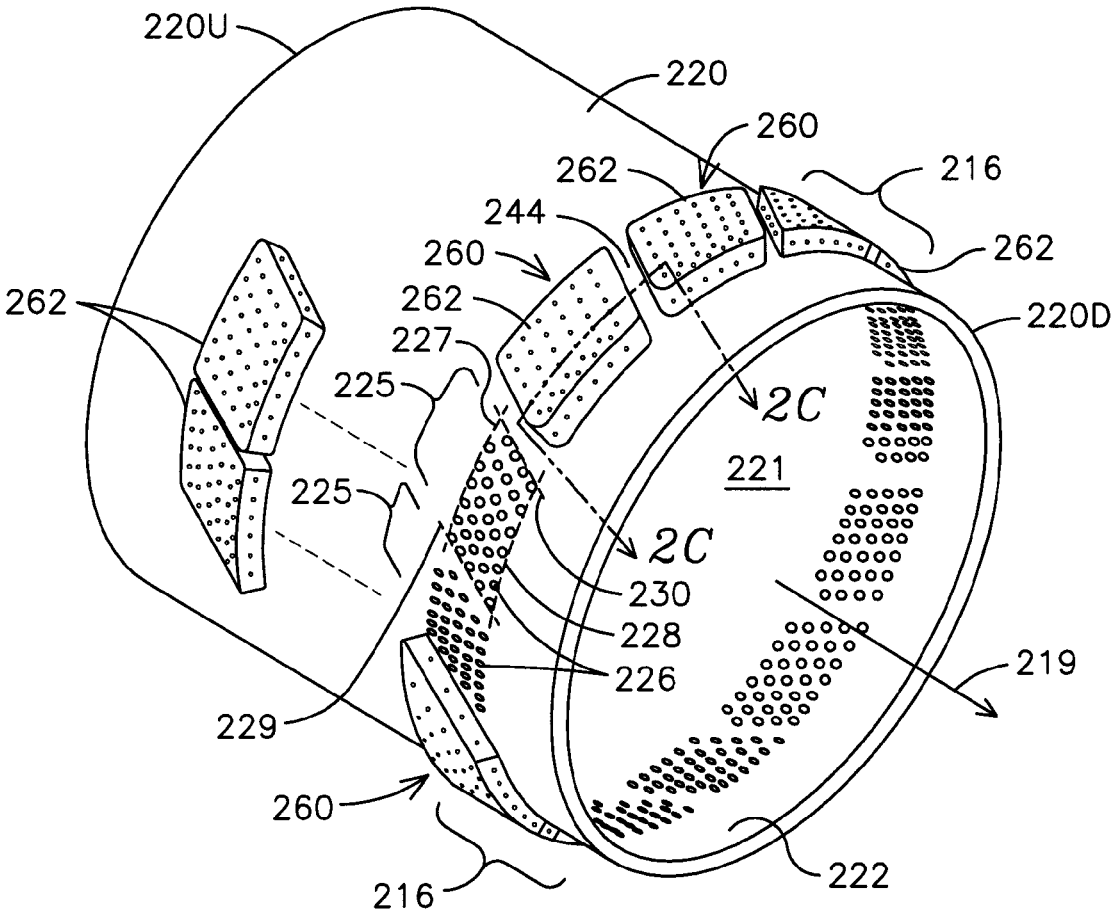
FIG. 2A provides a perspective view of an embodiment of the present invention comprising a combustor liner of a combustor, the liner having affixed to it a plurality of resonator boxes to form resonators, with two resonator boxes removed to expose respective underlying arrays of apertures on the liner.

FIG. 2B depicts a portion of the liner 220 of FIG. 2A having three adjacent arrays 225 of apertures 226, with a resonator box 262 covering each of two such arrays 225 (thus forming resonators 260). The three adjacent arrays 225, which are disposed through the cylindrically shaped liner 220 of FIG. 2A, are projected onto a plane represented by the drawing sheet for purposes of illustration, definition of angles, and comparison to similarly projected figures, such as FIG. 19D (i.e., providing a vertical orthographic plan view projection of the liner 220 and the resonator boxes 262). As shown for the exposed array 225, each array 225 may be defined geometrically by an upstream edge 250, a downstream edge 251, and two lateral edges 252 and 253. When, as illustrated, the lateral edges 252 and 253 meet at non-right angles with the upstream edge 250 and the downstream edge 251 (where these are substantially perpendicular to the flow-based longitudinal axis 219 of the liner 220), there is a benefit, namely, of flow from apertures 226 that are near and/or adjacent an intervening strip 224 are well-positioned to provide a cooling flow to film cool most or all of the intervening strip 224. That is, as to the intervening strips 244 of the liner 220 that are disposed between adjacent resonator boxes 262, fluid flowing from the apertures 226 within and adjacent the lateral edge 252 (or wall of resonator box that conforms with it, see below) upstream of a respective intervening strip is disposed and is effective to provide a film cooling to most or all of the intervening strip 244. Particularly, the apertures 226A that are adjacent and upstream on a flow axis basis of an intervening strip 244 are effective to cool the intervening strip 244 as well as adjacent weld seams (not shown, see below in FIG. 2C). This is particularly effective given the flow direction having an angle as depicted by flow vector line 50. Even some apertures of the next adjacent column, identified as 226B, will also provide a film cooling of some portions of the intervening strip 244.

An optional feature, depicted in FIG. 2B, is that adjacent rows of apertures 226 are offset from one another, to provide a staggered arrangement. This provides more uniform cooling along the liner 220. The apertures 265 of the resonator box 262 also are staggered.

Also as depicted in FIG. 2B, each resonator box 262 comprises an upstream wall 264, a downstream wall 266, two lateral walls 268 and 270—all of which attach to or are integral with a top plate 267 through which are provided apertures 265. The lateral walls 268 and 270 generally conform with the respective angling of the lateral edges 252 and 253 and intersect the upstream wall 264 and the downstream wall 266 at non-right angles, and the non-square parallelogram resonator 260 is thus formed. As noted above, one aspect of this embodiment is clear upon consideration of the effect of this angled parallelogram shape upon intervening strips 244. Namely, the intervening strips 244, and also weld seams (not shown, see FIG. 2C) at the intersection of the boxes 262 and the liner 220, are subject to film cooling by adjacent liner apertures 226.

Also referring to FIG. 2B, and while not meant to be limiting, are depicted an optional upstream thermal barrier coating (TBC) 231, extending from an upstream end (not shown) of the liner 220's interior surface and ending at an edge 232, and a downstream thermal barrier coating (TBC) 233 extending from a downstream end (not shown) of the liner 220's interior surface and ending at an edge 234. As to the downstream TBC edge 234, relative to the prior art this is shifted to a more upstream position so that the upstream edge of the downstream TBC edge 234 does not coincide with the weld seam (see FIG. 2C) along the edges of the resonator box 262. It is appreciated that the exact location of edge 234 is approximate in terms of location to the boxes 262, and may actually largely fall within the region defined by the depicted edge 234 and the adjacent dashed line 236. As depicted, this TBC edge 234 also is not interrupted by apertures through the liner 220. To maintain a predetermined level of cooling of this region, two rows of apertures 265 through top plate 267 are provided. These provide a desired level of impingement cooling in this region.

Figure 2C:
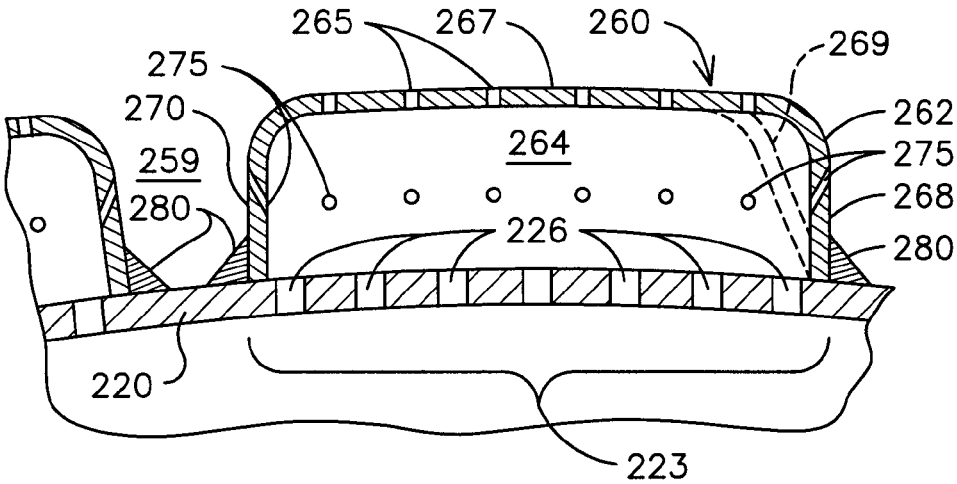
FIG. 2C provides a sectional view taken along the line C-C of FIG. 2A, showing features of a resonator embodiment of the present invention.

FIG. 2C provides a cross sectional view taken at section 2C-2C of FIG. 2A showing certain features of this embodiment. Viewable in FIG. 2C is the portion 223 of liner 220 enclosed by resonator box 262. This portion comprises apertures 226. Resonator box 262 is comprised of a top plate 267 that is integral and continuous with the side walls noted above, of which lateral wall 268 and 270 are viewable in this section. Upstream wall 264 is viewable out of section, and a column of apertures 265 are shown in top plate 267.

Also viewable in FIG. 2C are a plurality of lateral effusion apertures 275 on the lateral walls 268 and 270 of the resonator box 262. These provide a purging of the zone 259 between adjacent resonators, i.e., the space above the intervening strips 244. These lateral effusion apertures 275 also provide a small amount of impingement cooling on the liner 220 near weld seams 280. Effusion apertures also may be provided on the upstream and downstream walls (shown in FIG. 2C on 264). Also, it is noted that lateral apertures, disposed on the lateral walls, may be provided at any angle and need not be of an effusion type but may be any type of aperture, and may nonetheless be effective to purge the zone 259 between adjacent resonators.

It is noted that the walls 264, 266, 268 and 270 need not extend precisely vertically (as shown) from the combustor liner 220. For example, any or all of these walls may incline inwardly. A pair of dashed lines 269 is shown in FIG. 2C to exemplify one such inwardly inclining wall. Also, it is appreciated that embodiments of the invention may have walls 264, 266, 268, and 270 meeting at corners that are curved, such as is depicted in the figures (shown with some having smaller, some having larger radii), or at corners having sharply defined angles. Such variations are meant to be included within the scope of claimed embodiments.

Figure 2D:
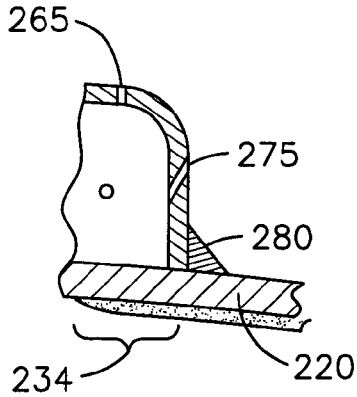
FIG. 2D provides a sectional view taken along the line D-D of FIG. 2B, showing features of a resonator embodiment of the present invention, particularly an optional tapered thermal barrier coating (TBC) region.

FIG. 2D provides a sectional view taken along the line D-D of FIG. 2B. This details an optional taper aspect of optional TBC edge 234, and also indicates that it is disposed upstream (yet adjacent) to more downstream weld seam 280. As depicted in FIG. 2D, TBC edge 234 is tapered in thickness along the flow-based longitudinal axis. Any predetermined profile of taper may be provided, and the taper in FIG. 2D is exemplary and not limiting. One aperture 265 is viewable.

While the angle of the lateral edges and lateral wall of the embodiment of FIGS. 2A-D is about thirty degrees (30 degrees) relative to the longitudinal flow-based axis of the combustor, it is appreciated that any non-right angle may be used in various embodiments of the present invention. For example, when the upstream and downstream lateral edges of apertures or walls are substantially perpendicular to the longitudinal flow-based axis, the angle of intersecting of the array lateral edges to the upstream or downstream lateral edge, or of the lateral walls to the upstream or downstream walls, may be between about 15 and about 75 degrees, and all values and subranges therein. More particularly, in various embodiments such angle may be between about 30 and about 60 degrees, and all values and subranges therein. To clarify, these angles pertain to the angles of the lateral walls and their edges where they contact the combustor liner, relative to the longitudinal flow-based axis of the combustor, rather than to any optional inward incline of these walls such as described above in the discussion of FIG. 2C.

Figure 3:
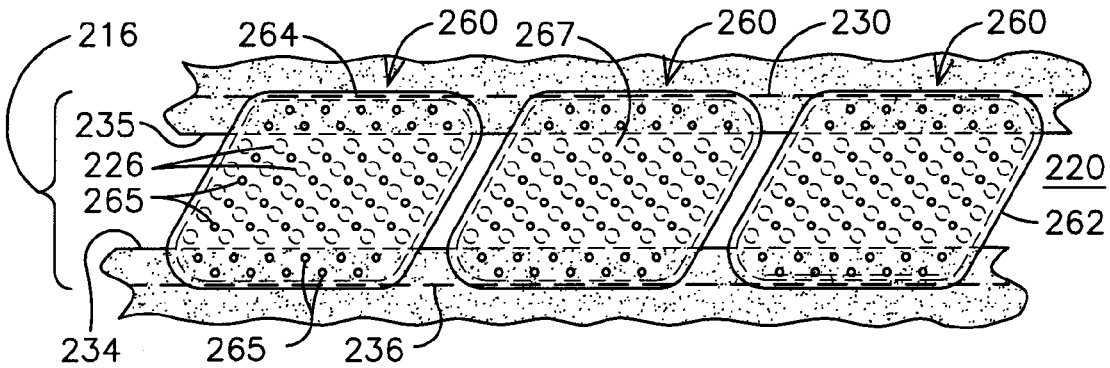
FIG. 3 provides a graphic depiction of adjacent resonators having additional features along the upstream region of the resonators.

FIG. 3 provides a graphic depiction of adjacent resonators 262 having optional features along the upstream region of the resonators 260. While not meant to be limiting, an optional upstream thermal barrier coating (TBC) edge 235 and a downstream thermal barrier coating (TBC) edge 234 are provided on the interior surface of the liner 220 in the relative positions indicated. These edges 235 and 234 are more interior of cylindrical region 216 than the respective TBC edges 132 and 133 of the prior art as depicted in FIG. 1D. As described as to FIG. 2B, the downstream TBC edge 234, relative to the prior art this is shifted to a more upstream position so that the upstream edge of the downstream TBC edge 234 does not coincide with the weld seam (see FIG. 2D) along the edges of the resonator box 262. This TBC edge 234 also is not interrupted by apertures 226 through the liner 220, and to maintain a predetermined level of cooling of this region, two rows of apertures 265 through top plate 267 are provided. These provide a desired level of impingement cooling in this region. In contrast with the TBC edges of FIG. 2B, here in FIG. 3 the upstream TBC edge 235 is similarly arranged with respect to the upstream wall 264. That is, the downstream edge of upstream TBC edge 235 is disposed more downstream of the weld seam (not shown, see for example FIG. 2C) along upstream wall 264 of the resonator box 262, and two rows of apertures 265 through top plate 267 are provided above the upstream TBC edge 235, which also does not comprise apertures 226 through the liner 220. This provides an alternative optional embodiment. It is appreciated that the exact location of edges 235 and 234 are approximate in terms of location to the resonators 260, and may actually largely fall within the region defined by the depicted edges 235 and 234 and the respective adjacent dashed lines 230 and 236. This also applies to the embodiment depicted in FIG. 2B.

Figure 4A:
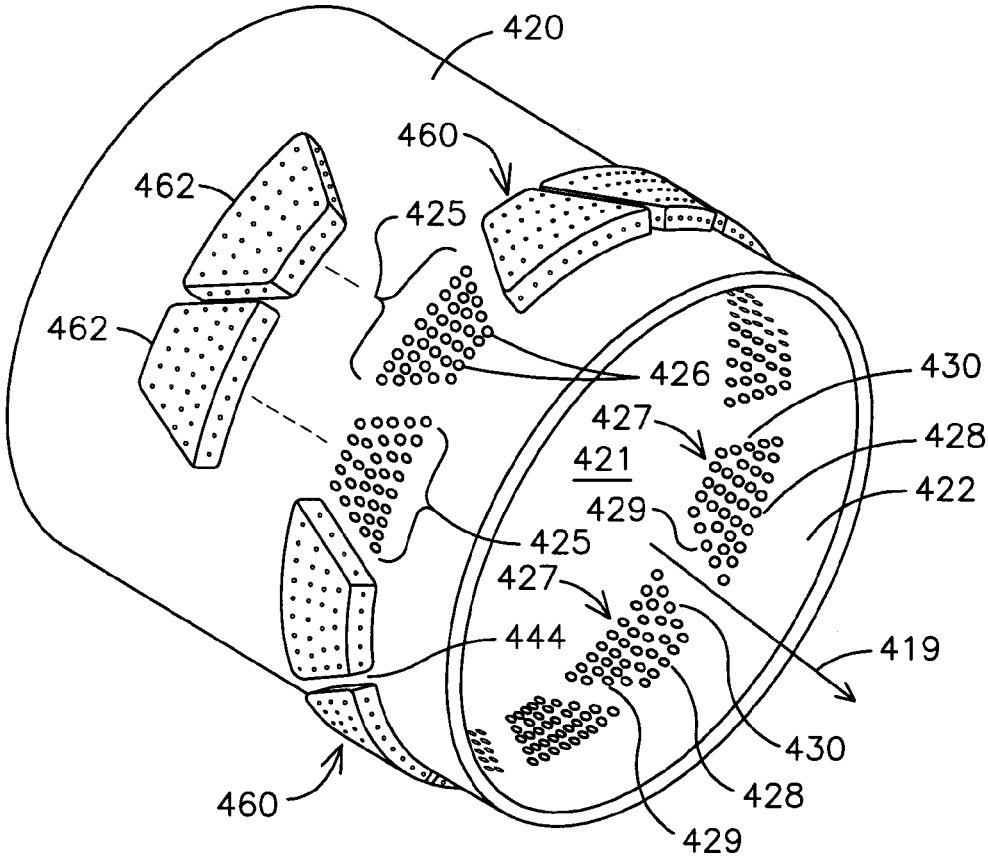
FIG. 4A provides a perspective view of a combustor liner of a combustor, the liner having affixed to it a plurality of resonator boxes of an alternative embodiment of the present invention, with two resonator boxes removed to expose underlying arrays of apertures on the liner.
Figure 4B:
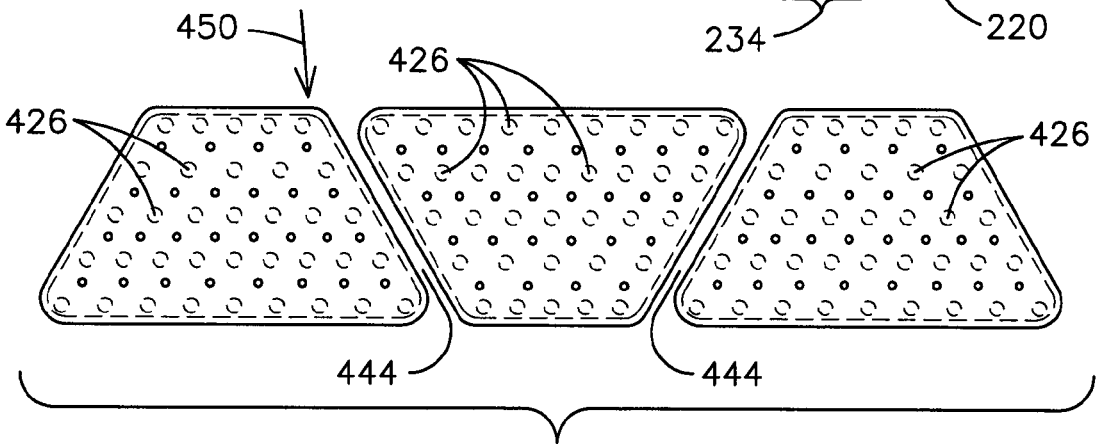
FIG. 4B provides an enlarged view of a portion of the combustor liner of FIG. 4A, depicting three adjacent arrays of apertures with a resonator box covering each of two such arrays, projected onto a planar surface.

Another alternative embodiment is directed to an alternative shape of the resonators and the consequent orientation of adjacent resonators. FIGS. 4A and 4B provide one example, not to be limiting, of this alternative embodiment. FIG. 4A provides a perspective view of a combustor liner 420 of a combustor for a gas turbine engine such as that depicted in FIG. 1A, which may have components such as those described for FIG. 1B. The combustor liner 420 defines in part an interior combustion chamber 421 having a flow-based longitudinal axis, indicated by arrow 419. Some of these apertures 426 are viewed along the interior surface 422 of the liner 420. The combustor liner 420 comprises a plurality of circumferentially arranged arrays 425 of apertures 426 through the liner 420, each of which is a component of a resonator 460 of the present invention. Each said array 425 may be defined geometrically by a non-rectangular four-sided trapezoid shape having an upstream edge 427, a downstream edge 428 which in the embodiment of FIG. 4A is substantially parallel with the upstream edge 427 (but wherein this is not meant to be limiting), and two lateral edges 429 and 430. It is appreciated that the array 425 is on a portion of the cylindrically curved liner 420, and it is further provided the lateral edges 429 and 430 of a particular array 425, when the array 425 is projected array onto a plane, are along lines that are non-parallel and therefore will converge beyond the upstream edge 427 or the downstream edge 428. That is, the arrays 425, and the resonators 460 that are formed when a resonator box 462 is affixed over a respective array 425, have a trapezoid-like shape. As used herein, a trapezoid is taken to mean a four-sided polygon having only two parallel sides.

While not meant to be limiting, it is appreciated that the shapes of the arrays 425 and the resonators 460 are like isosceles trapezoids in that they have congruent base angles. In other embodiments the base angles may differ, such as to compensate in part for the deviation from longitudinal direction of the flow within the combustion chamber 421.

The plurality of arrays are disposed circumferentially in a pattern that alternates so that adjacent arrays 425 and resonators 460 are closely spaced, leaving relatively narrow and uniform intervening strips 444.

It is appreciated that the cooling of the intervening strips 444 may occur substantially as described above for the earlier-disclosed embodiments. However, as observable in FIG. 4B, which depicts three adjacent arrays 425 of FIG. 4A projected onto a plane (i.e., providing a vertical orthographic plan view projection), the noted typical non-orthogonal direction of combusting gases (shown by arrow 450) is such that half the intervening strips 444 benefit greater than the other half as to receiving a film cooling from adjacent apertures 426 (in FIG. 4B, the intervening strip 444 adjacent the arrow 450 benefits less than the other intervening strip 444 shown). Nonetheless, the trapezoid-like shaped embodiments may find use in various gas turbine engine combustors, such as those in which the noted angular deviation of flow is small or non-existent, and/or when a non-isosceles trapezoid-like shape is used, where the respective angles are modified to compensate, at least in part, for the effect of the flow angular deviation.

The various embodiments that are exemplified herein by FIGS. 4A and 4B may be provided with the TBC and TBC edge optional alternatives described above, as well as other optional features described for the embodiment of FIGS. 2A-D.

Also, the various apertures of the embodiments may have any of a number of configurations, such as circular, oval, rectangular or polygonal. The apertures can be provided by any of a variety of processes, such as by drilling.

As used herein, "substantially parallel" is taken to mean exactly parallel or parallel within a reasonable degree so as to achieve the same functional results as an exactly parallel embodiment. For example, not to be limiting, the upstream and downstream array edges and resonator walls may be within five degrees, or alternatively within ten or fifteen degrees, of being exactly parallel and still fall within the meaning of "substantially parallel" for the purposes of this disclosure, including the claims. The same applies for other edges, walls, etc. where "substantially parallel" is used herein. Similarly, particularly for the purposes of the claims, "trapezoid-like shape" may include shapes in which lines, which in an exact trapezoid are exactly parallel, are in a particular embodiment "substantially parallel" as that term is defined in this paragraph.

Embodiments of the present invention may be used both in 50 Hertz and in 60 Hertz turbine engines, and are well-adapted for use in can-annular types of gas turbine engines. Can-annular gas turbine engine designs are well-known in the art. A can-annular type of combustion system, for example, typically comprises several separate can-shaped combustor/combustion chamber assemblies, distributed on a circle perpendicular to the symmetry axis of the engine.

All patents, patent applications, patent publications, and other publications referenced herein are hereby incorporated by reference in this application in order to more fully describe the state of the art to which the present invention pertains, to provide such teachings as are generally known to those skilled in the art.

While various embodiments of the present invention have been shown and described herein, it will be obvious that such embodiments are provided by way of example only. Numerous variations, changes and substitutions may be made without departing from the invention herein. Moreover, when any range is described herein, unless clearly stated otherwise, that range includes all values therein and all subranges therein. Accordingly, it is intended that the invention be limited only by the spirit and scope of the appended claims.

What is claimed is:

1. A combustor for a gas turbine engine comprising:

a combustor liner defining an interior combustion chamber having a flow-based longitudinal axis, the combustor liner comprising a plurality of circumferentially arranged arrays of apertures there through, each said array defined by a non-rectangular four-sided shape having an upstream edge, a downstream edge, and two lateral edges, each lateral edge, based on projection of the array onto a plane, intersecting with the upstream and downstream edges at an angle other than a right angle;

a plurality of resonator boxes affixed to the liner, each said resonator box covering a respective array and having lateral walls conforming with the respective angles of the lateral edges, and each said resonator box comprising an upstream wall, a downstream wall, and lateral walls affixed to the liner;

a downstream-TBC disposed along the inside surface of the combustor liner from a location downstream of the plurality of resonator boxes to a TBC first edge disposed upstream of the downstream wall, wherein no apertures through the liner pass through a portion of the downstream-TBC that is upstream of the downstream wall, and wherein impingement apertures through a top plate of the resonator box are provided over the portion of the downstream-TBC that is upstream of the downstream wall, wherein intervening strips of liner remain between adjacent resonator boxes; and wherein fluid flowing from the apertures within and adjacent the lateral wall upstream of a respective intervening strip is disposed to provide a film cooling to the intervening strip.

2. The combustor of claim 1, wherein the two lateral edges are disposed substantially parallel to one another.

3. The combustor of claim 1, wherein the two lateral edges are defined by lines that converge beyond the upstream edge or the downstream edge.

4. The combustor of claim 3, additionally wherein each said array forms, based on the projection of the array onto the plane, a trapezoid-like shape.

5. The combustor of claim 1, wherein the apertures of each array are arranged in rows perpendicular to the flow-based longitudinal axis, and wherein the apertures of a first row are offset sideways in relation to apertures of an adjacent row, to provide a staggered pattern effective for cooling the liner.

6. The combustor of claim 1, the combustor additionally comprising an upstream-TBC along the liner interior surface from a location upstream of the plurality of resonator boxes and ending at a second edge disposed downstream of the upstream wall, wherein no apertures through the liner pass through a portion of the upstream-TBC that is downstream of the upstream wall, and wherein impingement apertures through a top plate of the resonator box are provided over the portion of the upstream-TBC that is downstream of the upstream wall.

7. The combustor of claim 1, wherein the first TBC edge is tapered in thickness along the flow-based longitudinal axis.

8. The combustor of claim 6, wherein the second TBC edge is tapered in thickness along the flow-based longitudinal axis.

9. The combustor of claim 1, wherein each said angle of intersecting of the array lateral edges is between about 15 and about 75 degrees.

10. The combustor of claim 1, wherein the lateral walls additionally comprise a plurality of lateral apertures effective to purge a zone between adjacent resonators.

11. A gas turbine engine comprising the combustor of claim 1.

12. The combustor of claim 1, wherein each said lateral wall is disposed at an angle between about 15 and about 75 degrees relative to the longitudinal flow-based axis.

13. The combustor of claim 1, wherein each said lateral wall is disposed at an angle between about 30 and about 60 degrees relative to the longitudinal flow-based axis.

14. A gas turbine engine comprising the combustor of claim 12.

15. A combustor for a gas turbine engine comprising:

a plurality of portions of a liner of the combustor, each portion comprising a pattern of apertures there through, to provide a staggered pattern effective for cooling the liner;

a plurality of resonators arranged circumferentially about the liner of the combustor, each resonator comprising a resonator box covering a respective portion of the liner and comprising an upstream wall, a downstream wall, two lateral walls each affixed to the liner by welding thereby forming weld seams, and a top plate attached to or integral with the walls, the top plate comprising a plurality of apertures, wherein the two lateral walls are disposed so as to lie not parallel to a longitudinal flow-based axis and wherein a plurality of lateral effusion apertures are provided on the lateral walls; and a thermal barrier coating (TBC) disposed along an inside surface of the liner from a liner downstream end to a tapered edge disposed upstream of a weld seam attaching the downstream wall to the liner, wherein no apertures through the liner pass through a portion of the TBC upstream of the weld seam attaching the downstream wall to the liner, and a plurality of top plate apertures are provided radially outward from the TBC edge and between the weld seam attaching the downstream wall to the liner and the TBC edge.

16. The combustor of claim 15, additionally comprising a second TBC disposed along the inside surface of the liner from a liner upstream end to a tapered edge downstream of a weld seam attaching the upstream wall to the liner, wherein no apertures through the liner pass through the second TBC edge and a plurality of top plate apertures are provided radially outward from the second TBC edge.

17. The combustor of claim 15, wherein each said lateral wall is disposed at an angle between about 15 and about 75 degrees relative to the longitudinal flow-based axis.

18. A combustor for a gas turbine engine comprising: a combustor liner defining an interior combustion chamber having a flow-based longitudinal axis, the combustor liner comprising a plurality of circumferentially arranged arrays of apertures there through, each said array defined by a non-rectangular four-sided shape having an upstream edge, a downstream edge, and two lateral edges, each lateral edge, based on projection of the array onto a plane, intersecting with the upstream and downstream edges at an angle other than a right angle;

a plurality of resonator boxes affixed to the liner, each said resonator box covering a respective array and having lateral walls conforming with the respective angles of the lateral edges, and each said resonator box comprising an upstream wall, a downstream wall, and lateral walls affixed to the liner;

an upstream thermal barrier coating TBC disposed along an inside surface of the combustor liner from a location upstream of the plurality of resonator boxes to a TBC edge disposed downstream of an upstream wall of each said resonator box, wherein no apertures through the liner pass through a portion of the upstream-TBC that is downstream of the upstream wall, and wherein a plurality of apertures through a top plate of the resonator box are provided over the portion of the upstream-TBC that is downstream of the upstream wall;

wherein intervening strips of liner remain between adjacent resonator boxes; and wherein fluid flowing from apertures in the liner within and adjacent the lateral wall upstream of a respective intervening strip is disposed to provide a film cooling to the intervening strip.

19. The combustor of claim 18, wherein the two lateral edges are disposed substantially parallel to one another.

20. A gas turbine engine comprising the combustor of claim 18.

* * * * *